US005415539A

United States Patent [19]

Musil

[11] Patent Number: 5,415,539

[45] Date of Patent: May 16, 1995

[54] BURNER WITH DISPERSING FUEL INTAKE

[75] Inventor: Joseph E. Musil, Ely, Iowa

[73] Assignee: Cedarapids, Inc., Cedar Rapids, Iowa

[21] Appl. No.: 193,739

[22] Filed: Feb. 9, 1994

[51] Int. Cl.[6] ..... F23M 9/00

[52] U.S. Cl. ..... 431/181; 431/183; 431/351; 431/354; 239/404; 239/406

[58] Field of Search ..... 431/8, 9, 10, 181–185, 431/350, 354, 351; 60/737, 742, 738, 739, 748; 239/403, 424.5, 423, 425.5, 404, 406

[56] References Cited

U.S. PATENT DOCUMENTS

| | | | |
|---|---|---|---|
| 1,680,455 | 8/1928 | Fesler et al. . | |
| 2,473,347 | 6/1949 | Sanborn . | |
| 3,612,737 | 10/1971 | Sharan . | |
| 3,846,062 | 11/1974 | Quinn | 431/116 |
| 4,095,929 | 6/1978 | McCartney . | |
| 4,298,337 | 11/1981 | Butler et al. . | |
| 4,333,405 | 6/1982 | Michelfelder et al. . | |
| 4,600,377 | 7/1986 | Musil . | |
| 5,145,359 | 9/1992 | Ancona et al. . | |
| 5,154,596 | 10/1992 | Schwartz et al. . | |
| 5,192,204 | 3/1993 | Musil . | |
| 5,251,447 | 10/1993 | Joshi et al. | 60/742 |

FOREIGN PATENT DOCUMENTS

| | | | |
|---|---|---|---|
| 123945 | 2/1984 | United Kingdom . | |
| 802707 | 2/1981 | U.S.S.R. | 431/182 |
| 1537958 | 1/1990 | U.S.S.R. | 431/181 |

*Primary Examiner*—James C. Yeung

*Attorney, Agent, or Firm*—Simmons, Perrine, Albright & Ellwood

[57] ABSTRACT

A burner unit has a fuel dispersion arrangement at a burner head leading to a flame region which distributed fuel from longitudinal slots extending along trailing edges of spinner vanes of a spinner vane assembly. The spinner vane assembly is disposed transversely across a flow channel of combustion air past the burner head and has a function of deflecting the axial flow of the combustion air radially outward into a conical flow. The deflective air flow pressure distribution over the spinner vanes contributes to induction and mixing of the fuel with the combustion air as the combustion air enters the flame region of the burner. Combustion gases resulting from a combustible mixture achieved in this manner have resulted in emission products with pollutant levels within currently specified limits.

14 Claims, 2 Drawing Sheets

BURNER WITH DISPERSING FUEL INTAKE

BACKGROUND OF THE INVENTION

This invention relates generally to industrial type burners, and more particularly to fuel intake provisions to industrial type burners.

Industrial type burners with a high-BTU capacity typically work on a comparatively volumous gaseous throughput, and they can become generators of significant amounts of air pollutants if they are improperly adjusted. The burner design specifications are such that the operation of these burners would at least seek to meet specified maximum levels of nitrous oxides and unburned hydrocarbons in combustion gas emissions. State of the art burners usually can be adjusted to optimize both nitrous oxide and unburned hydrocarbon levels of emissions down to acceptable levels. Often, however, an adjustment to minimize burner emissions with respect to of either one of the pollutants does not coincide with an optimum adjustment for minimum emission level of the other of the pollutants. Thus, for most burners, optimum adjustments of such variables as fuel to air ratios, excess or secondary air induction, or pressure levels of turbo air used as primary combustion air is, at best, a compromise. An optimum burner adjustment hopefully reduces both the nitrous oxide and hydrocarbon emissions to levels which meet prescribed requirements.

A known process of enhancing the mixture of fuel with combustion air in burners is to use relative motion between the fuel and the combustion air. A known axial flow turbo-burner type uses a swirling stream of combustion air into which fuel is injected to enhance mixing of the fuel with combustion air, which, in turn, tends to reduce pollutant levels in the effluent gases. U.S. Pat. No. 5,192,204 to Musil teaches dispersing, for example, liquid fuel by compressed air to initially atomize the fuel. The atomized fuel is then introduced into a flame region of a burner. Upon entering the flame region, the atomized fuel becomes entrained in a conically expanding pattern of a first stream of primary combustion air. The first stream of primary combustion air is then further mixed with a variable second stream of combustion air. Successive steps of mixing the fuel with combustion air and the mixture with further combustion air appears to improve fuel-air mixtures and the quality of emissions. However, meticulous adjustments of each of the various air streams may be needed to optimize pollutant levels and maintain combustion emissions under control. With continued emphasis on cutting down on air pollution, even in those industries which necessarily use high-output industrial burners, such as in aggregate and asphalt plants, further efforts are needed to make it easier to reduce pollutant generation by these burners.

SUMMARY OF THE INVENTION

It is therefore an object of the invention to provide a burner with improved, pollutant reducing combustion characteristics.

It is another object of the invention to improve an axial flow, turbo burner to achieve a high degree of fuel dispersion, resulting in a flame with low level hydrocarbon and nitrous oxide emissions, in comparison to prior art burner systems.

It is a further object of the invention to provide an improved fuel injection system for a turbo burner.

Rephrasing an object of the invention, it is endeavored to reduce hydrocarbon and nitrous oxide levels in combustion products of a burner unit by an improved uniformity of fuel dispersion into combustion air to provide a more uniform combustion mixture as it is routed to a combustion region or flame region of the burner unit.

It is yet a further object of the invention to improve combustion in an axial flow turbo burner unit with an apparatus or arrangement which mixes fuel with combustion air substantially uniformly within a plane transverse to the flow of the combustion air.

Accordingly, the present invention is an improvement of a burner unit which generally includes a burner head disposed at the beginning of a flame region of the burner unit. A fuel duct leads to the burner head to supply fuel which is introduced at the burner head into the flame region. An air supply is coupled by a duct to the burner head to supply a stream of combustion air to flow generally in an axial direction past the burner head toward a flame region. In a plane transverse to the axial direction, there is disposed a spinner vane assembly. The spinner vane assembly is comprised of a plurality of radially oriented spinner blades in the general shape of an airfoil. The spinner blades are disposed at an angle with respect to the axial direction to introduce a spin into the stream of the combustion air as the combustion air enters the flame region.

According to the invention, fuel duct is coupled to a manifold which communicates with each of the spinner blades. The spinner blades are hollow, the interior of each of the blades forming a radial duct for the fuel. The spinner blades further have an opening disposed along a trailing edge of the spinner blades and communicating with the respective radial ducts within the spinner vanes. Air flowing over the spinner vanes past the trailing edges mixes with the fuel as the fuel is drawn from the trailing edges of the spinner vanes.

Other features and advantages of the invention will become apparent from reading the detailed description below.

BRIEF DESCRIPTION OF THE DRAWINGS

The detailed description of the invention may be read in reference to the appended drawing wherein.

DETAILED DESCRIPTION OF THE INVENTION

Figure 1:
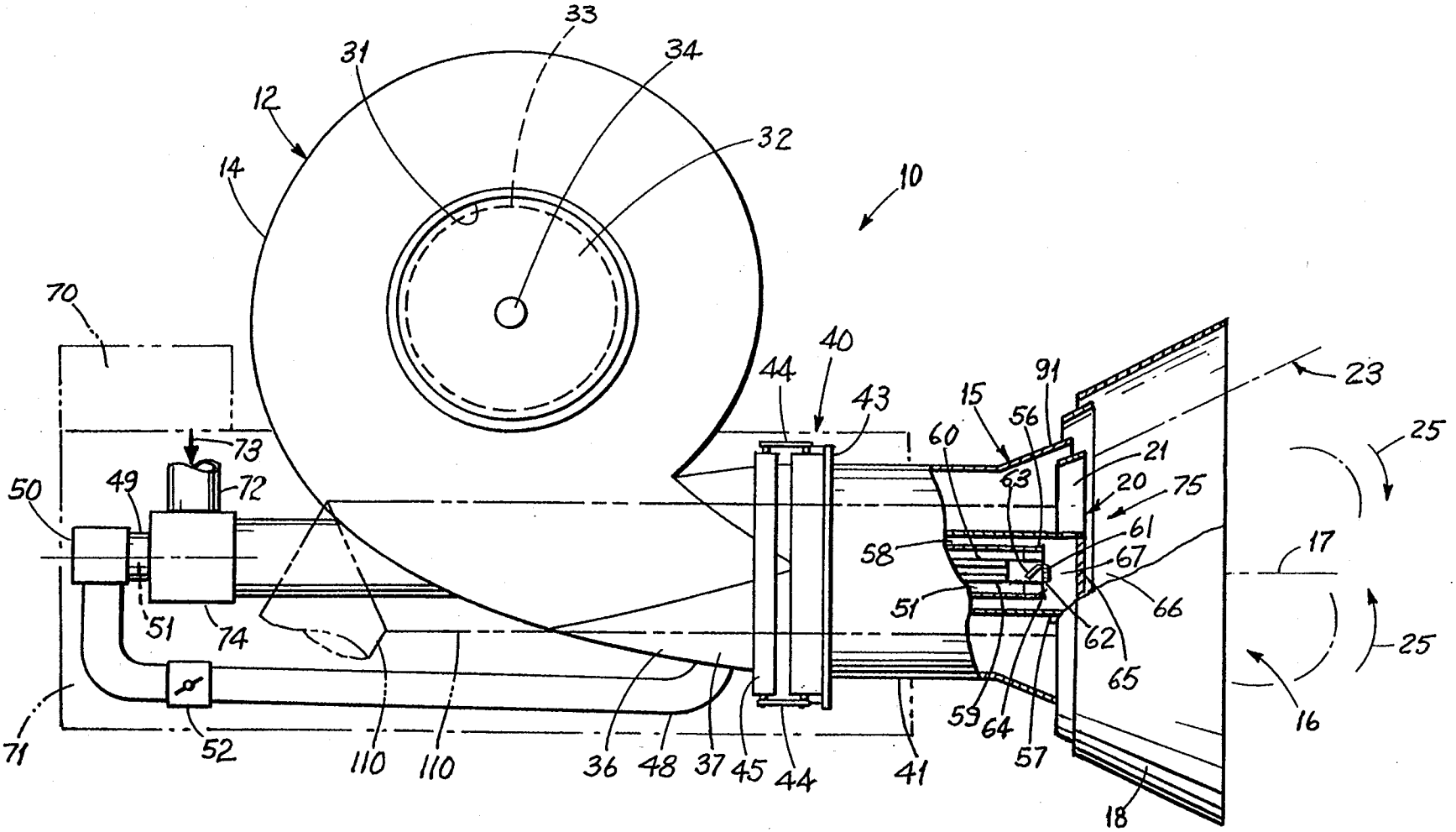
FIG. 1 is a simplified, partially sectioned view of a turbo burner unit to which the invention advantageously pertains, the burner showing a burner head with particular features of the invention.

FIG. 1 shows a side elevation of a burner unit 10. The burner unit 10 in the preferred embodiment of the invention is also more specifically referred to as a turbo burner unit 10 in that it uses a forced combustion air supply provided by a motor-driven turbo compressor unit 12. The turbo compressor unit 12 is readily identified by a characteristic turbo-housing 14 of circular shape. The turbo compressor unit 12 is capable of feeding a stream of turbo combustion air under an elevated pressure of 11 to 12 percent above atmospheric pressure past a burner head 15 into a flame region or combustion region 16 of the turbo burner unit 10. The burner head 15 functions as an interface between, on the one side, a supply of combustion air and those functional elements serving to supply fuel to the burner unit 10, the latter elements being generically referred to as a fuel source, and on the other side, the actual combustion process. The general function of the burner head 15 is, consequently, to promote the mixing of fuel with the combustion air to obtain efficient combustion in the flame region 16 of the burner unit 10. The flow of combustion air directed from the turbo compressor 12 to the burner head 15 is generally an axial flow along what is considered to be a longitudinal burner axis 17. The turbo compressor 12 is, hence, located "upstream" from the burner head 15, while the flame region 16 of the burner unit is located "downstream" of the burner head 15 along the longitudinal axis 17 of the burner unit 10. A flow velocity of the combustion air past the burner head 15 typically varies according to the demand of combustion air depending on a particular setting of the burner unit 10. With high combustion air velocities, a flame in the flame region may become unstable. The burner head 15, consequently, includes also flow diverters to alter the flow pattern of the combustion air in the flame region in a manner that will sustain the flame over a range of workable burner settings from a maximum output setting to a minimum at which a flame can be sustained. This range is usually referred to as the "turn-down" range. As the flame region 16 is preferably bounded by a flame holder cone 18, the burner head 15 may include such axial flow generators as cooperatively shape the gas flow from a generally axial direction toward the desired gas flow pattern within the flame holder cone 18.

U.S. Pat. No. 5,192,204 pertaining to a state-of-the-art multi-step combustion air and fuel mixing arrangement, also describes a conically outward directed flow pattern which results in a low if not reverse axial flow direction of combustion gases in a central portion of a corresponding flame holder cone. The reverse flow turbulence slows the flame progression in the conically expanding flame holder cone 18 to cause the flame to remain substantially stable over a usual turn-down range of burner settings. As the fuel and air supply is varied over the active range, the gas flow and the reverse flow turbulence also change to increase, or decrease correspondingly caused by the similarly varying outward draft along the expanding wall of the flame holder cone. Only at a lowermost setting, or when first ignited, would the flame be maintained by a pilot flame and ignitor assembly (not shown). A known ignitor assembly is generally mounted at a convenient location to extend through the burner structure into the flame region.

Figure 5:
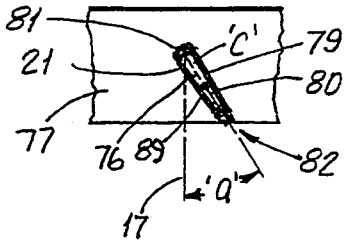
FIG. 5 is a sectional view through the spinner blade shown in FIG. 4, viewed in the direction "5—5".

Similarly to axial flow type turbo burner units of the known art, the burner unit 10 features a spinner blade assembly 20 of a plurality of spinner blades 21. The spinner blade assembly 20 is symmetrically mounted about the longitudinal axis or central flow axis 17 of the burner unit 10. The spinner blade assembly 20 is, however, a "stator" unit which does not rotate, hence, it remains stationary with respect to the burner unit 10. Each of the spinner blades 21 extends generally radially outward from the longitudinal axis 17, such that the spinner blade assembly 20 extends in a transverse plane across a flow pattern of the combustion air past the burner head 15. However, the spinner blades or vanes 21 could be sloped toward or away from that transverse plane, as a modification of a preferred embodiment. Each spinner blade 21 has a cross section in the shape of an airfoil. In reference to FIGS. 1 and 5, the spinner blades 21 are skewed at a predetermined angle "a" with respect to the flow direction of the combustion air along the longitudinal axis 17 past the burner head 15. The angle of skew of the spinner blades 21 determines a degree or amount of deflection of the combustion air from its generally axial flow path. The deflection of the combustion air into a rotational skew or "spin" with respect to the axis 17 adds a radially outward directed component to the axial flow, and causes a conically outward-directed gaseous flow pattern 23 within the flame region 16. The conical, gaseous flow pattern, in turn, brings about a desired reverse-flow turbulence in the flame region 16, as indicated by the flow arrows 25, the turbulence preventing the flame from being carried downstream by otherwise high velocities of the gaseous flow. The turbulent reverse flow consequently serves to retain the flame in the flame region 16 over the contemplated range of burner settings.

The choice of the angle "a" of deflection of the spinner blades 21 from the axial flow direction of the combustion air should be the result of experimentation. The angle "a" may need to be optimized to obtain a desired outward deflection of the combustion air toward the frustro-conical surface of the flame holder cone 18. An angle of attack "a" in a range of 30 to 40 degrees with a preferred angle of attack of 35 degrees of a chord "c" was chosen in the preferred embodiment to adapt the gaseous flow to a conical expansion flow of approximately 30 degrees away from the longitudinal flow direction.

Referring again to FIG. 1, a motor driven turbo blower fan 31 draws in air through a central air inlet 32. The blower fan 31 radially compresses the air while maintaining a desired flow volume. Typically, an elevated pressure exceeding the ambient, atmospheric pressure by 11 to 12 percent can be maintained over a working range of desired burner settings. The turbo blower fan 31 may be driven by any prime mover, as for example an electric motor 33 which is centrally coupled to the blower fan 31 via a central shaft 34. The generally circular turbo housing 14 directs the centrifugally pressurized turbo air via an outlet 36 of the housing to a turbo air transition duct 37. The transition duct 37 directs the turbo air via an air valve assembly or air damper assembly 40 to flow into a substantially cylindrical inlet duct 41 of the burner head 15. The air damper assembly 40 throttles and regulates the air flow or amount of air channeled through the spinner vane assembly 20 of the burner head 15 for any of various burner settings. Thus, as power settings or combustion settings of the burner unit 10 are decreased from a maximum setting, for example, the air damper assembly 40 would be closed to admit a lesser amount of combustion air to the burner head 15. The damper assembly 40 may be a known assembly, using a plurality of damper blades 42 (see FIG. 2) which are pivotally mounted to pivot about respective radial axes to increase or decrease free openings for air flow past the damper assembly 40. The inlet duct 41 features a flange 43 which advantageously may be used to mount the air damper assembly 40. Crank arms 44 (two of which are shown) at outer ends of each of the blades are interlinked via a rotator ring 45 which simultaneously turns all of the blades via the respective crank arms 44 to adjust the opening of the damper assembly 40. Upstream of the damper assembly 40, a bleeder duct 48 for drawing turbo air is coupled into the transition duct 37. The bleeder duct 48 has the capability of drawing turbo air with little drop in static pressure of the output from the turbo blower 31, and routing the drawn off turbo air to the rear or tail end 49 of the burner unit 10, where it may be introduced via a coupling 50 into a central space 51 leading longitudinally of the burner unit 10 to the burner head 15. A throttle valve 52 may be used to selectively regulate or throttle back on the turbo air introduced centrally into the burner unit 10.

FIG. 1 shows an embodiment of the invention which represents an improvement of a turbo burner of a type described in the above-mentioned U.S. Pat. No. 5,192,204. However, as will become apparent, the advantages, features and know-how gained from the description of the invention herein allows one skilled in the burner art to apply and practice the invention in conjunction with other burners. Reference to various features of the preferred embodiment should be considered as being illustrative of and not limiting to the scope of the invention. A longitudinal, concentric placement of first and second tubes 56 and 57 form the central space 51 within the innermost concentric tube 56, and an annular space 58 between the tube 56 and the outer concentric tube 57. The central space 51 is further used to route, in a manner similar to known use of such central space, compressed air and liquid fuel through lines 59 and 60, respectively. The compressed air and liquid fuel lines 59 and 60 terminate at a fuel atomizer assembly or nozzle 61 of the burner head 15. The known function of the atomizer assembly 61 is to disperse liquid fuel with the help of high pressure gas into a fine mist or spray of very small droplets of fuel and to direct this spray in a conically spreading pattern into the flame region of a burner. Accordingly, the atomizer assembly 61 has an apertured, tapered front end 62 from which small droplets of fuel are ejected in the desired conically dispersing stream. An arrangement of spinner vanes 63 disposed radially about, and forming part of the preferred atomizer assembly 61, spin the turbo air as it passes over the spinner vanes 63 away from the central space 51 of the inner concentric tube 56. According to known art, an atomizer assembly terminates at an interface to a flame region. In contrast to other known arrangements, the burner head 15 is modified, with the atomizer assembly 61 and an end 64 of the inner concentric tube being, for example, set back within the outer concentric tube 57, to permit the burner head to function in accordance with the present invention in an operational mode in which liquid fuel may be burned.

The embodiment shown in FIG. 1 is capable of operating with a fuel which is supplied in a gaseous state, as well as with a liquid fuel, and of dispersing such gaseous fuel via an arrangement in accordance with the present invention. The burner unit 10 may be converted readily to burn either liquid or gaseous fuel such as LP gas, for example. The end 64 of the inner concentric tube with the atomizer assembly 61 being set back as shown, a circular cover plate 65 advantageously seals off the outer concentric tube 57 at a frontal end 66 of the burner head 15. The recessed position of the inner concentric tube 56 with the atomizer assembly 61 and the sealed off end 66 of the outer concentric tube 57 transforms an inner end of the outer concentric tube into a fuel manifold chamber 67 as will become apparent from the overall description of the fuel distribution arrangement below. Alternate embodiments become apparent in the form of a modification of an existing multifuel burner which is to be operated only with a gaseous fuel. In a modification of an existing burner in which an atomizer assembly is not used, the atomizer assembly would not need to be recessed as described herein. Thus, sealing off an annular space between corresponding inner and outer tubes of the existing burner unit would generate an annular gas-fuel manifold chamber. Such annular manifold chamber is an equivalent of the manifold chamber 67.

Also, the cover plate 65 may, consistent with its function, be rounded outwardly or be of conical shape, the conical shape extending into the flame region 16. Functionally, in a gas fired burner unit 10, the cover plate 65 seals the space within the outer concentric tube 57 from leading directly into the flame region 16. As part of a gaseous fuel supply to the burner head 15, the annular space 58 functions as a fuel duct 58 which routes gaseous fuel to the burner head 15. The annular space 58 is coupled to and leads directly into the manifold chamber 67. As a duct for feeding gaseous fuel to the burner head 15, the annular duct 58 would be coupled to a gaseous fuel supply 70, schematically shown next to a typical burner support frame 71. The burner support frame 71, also shown in phantom lines, schematically represents a support for the burner unit 10 and its component parts. The burner support frame 71 may further include a support structure of related apparatus, such as a frame of an overall structure 70 of a typical aggregate dryer.

When operating the burner unit 10 with a gaseous fuel, gaseous fuel from the supply 70 is coupled to and routed via a feeder pipe 72, as shown by an arrow 73, to the annular space 58. When the burner unit 10 is to be operated with a liquid fuel, the feeder pipe 72 may be coupled to a source of oxygen-poor carrier gas. For either operation, the physical structure of the burner unit 10 remains essentially the same. The feeder pipe 72 is connected to a manifold coupling 74. The coupling 74 admits a gaseous fluid such as the fuel into the annular space 58, peripherally about the inner concentric tube 56 and interiorly of the outer concentric tube 57.

Figure 4:
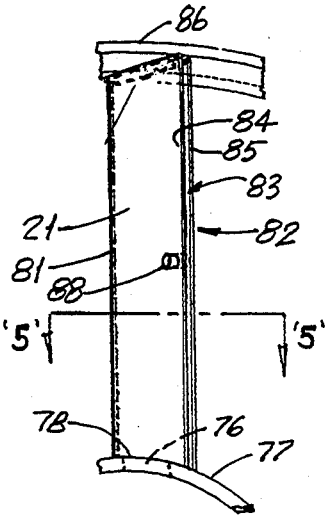
FIG. 4 is a partial end view of the spinner assembly and particularly of a single spinner blade of the spinner assembly shown in FIG. 3.

Particular features of a fuel dispersion arrangement 75 in accordance herewith will be explained in reference to FIGS. 2, 3, 4 and 5. Slotted openings or apertures 76 are peripherally evenly spaced through the wall of the manifold chamber 67 formed at the end of the outer concentric tube 57. The slotted openings 76 extend as communicative channels through the wall of the outer concentric tube 57 and then further through a center support ring 77 of the spinner vane assembly 20. Each of the slotted apertures or channels 76 is coincident with and leads into a base 78 of a respective one of the spinner vanes 21. The spinner vanes 21, as is best seen in FIG. 4, are hollow, each being formed of a sheet of metal which is bent back on itself to form a shell 79. The hollow shell 79 encloses an interior space 80 which extends the length of the spinner vane 21, forming a gas distribution chamber 80. The airfoil shell 79 has a solid, rounded leading edge 81 and has, preferably, an open trailing edge 82. The trailing edge 82 consists of the two overlapping adjacent trailing edges of the formed shell 79. A slot or longitudinal gap 83 is formed by the spacing between adjacent formed-over trailing sheet metal edges 84 and 85 which constitute the trailing edge 82. The gap or slot 83, in a presently preferred embodiment, has, at least as specified, a uniform gap width between the edges 84 and 85 over the radial length of the respective spinner vane 21. It should be understood, as with other manufactured items, that there may be a manufacturing tolerance which may cause a variation from a nominal gap width. Also, from the further discussion hereof, a resulting substantially uniform gap width is a preferred embodiment of the invention. Other opening patterns may be acceptable or even preferred, particularly in spinner assemblies in which the radial air flow distribution differs from the radial air flow distribution over the airfoils of the spinner vanes 21. The gas distribution space or chamber 80 is closed off peripherally outward by an outer, conically shaped, circumferential vane assembly band 86. The outer ends of the spinner vanes 21 are preferably welded to the vane assembly band 86, the weld seam in combination with the enclosed surface portion of the vane assembly band 86 forming outward boundaries or seals of the gas distribution chambers 80. Consequently, any gas flowing into the respective gas distribution chambers 80 within each of the spinner vanes 21 would necessarily have to exit therefrom through the respective slots 83 longitudinally of the trailing edges 82 of the spinner vanes 21.

As a particular example of the fuel dispersion arrangement 75, as implemented by the spinner vane assembly 20 of hollow spinner vanes 21 in accordance herewith, a preferred embodiment of the spinner vane assembly 20 has a nominal overall outside diameter of 55 cm (centimeter). The inner support ring 77 has a nominal diameter of 17 cm. Consequently, a radial gap length of the gap or slot 83 at the trailing edge 82 of each vane 21 is 19 cm long. A corresponding gap width was chosen to be a nominal 0.32 cm over the length of the trailing edge 82. To maintain the gap opening over the length, a spacer plug 88 may be inserted through respective, matching holes in the formed shell 79 to be welded to each of respective portions of the shell 79. The welded spacer plug 88 establishes and maintains the gap width of each vane 21 adjacent substantially the center of the respective vane, allowing the vanes 21 to become welded or otherwise attached to the inner support ring 77 and to the peripheral vane assembly band 86 without having to measure or set the gap at that time.

Figure 3:
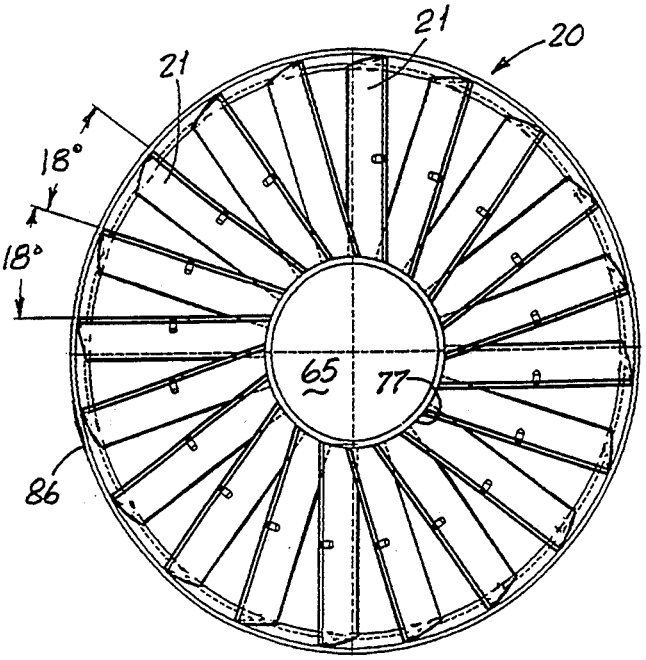
FIG. 3 is an end view of a spinner assembly of the burner head viewed in the direction "3—3" as indicated in FIG. 2.

The embodiment of the spinner vane assembly 20 depicted in FIG. 3 is a twenty-vane assembly. It should, however, be understood that not only the physical size, but also the number of vanes in the spinner vane assembly 20 may be altered without departing from the spirit and scope of the invention. It is to be realized that differences in the number of spinner vanes 21 chosen to be arranged within the assembly, affect the open path or spacing between adjacent spinner vanes 21, and, hence, the angular uniformity of fuel dispersion. Using twenty circumferentially distributed fuel dispersion lines in a plane transverse to the general axial flow of the combustion air has yielded a notable improvement in the combustion process of burner unit 10 over prior art burners. Though clearly not the only effective fuel dispersion arrangement 67 in accordance herewith, it does constitute at this time a preferred embodiment. Twenty spinner vanes 21 are, consequently, spaced at eighteen degree spacings with respect to adjacent vanes. A 55 cm outer diameter and an angle of thirty-five degrees of deviation from the longitudinal axis of the spinner vanes 21 yields a center to center spacing between adjacent spinner vanes 21 of approximately seven centimeter adjacent the outer periphery of the spinner vane assembly 20. The center to center spacing decreases radially inward, of course. Wake turbulence across the less than pointed trailing edges 82 of the spinner vanes 21 is believed to contribute advantageously in the dispersion of fuel transversely to the plane of the spinner vanes to mix with combustion air that passes between adjacent ones of the spinner vanes. A rather uniform fuel dispersion appears to hold true for substantially the entire length of each of the spinner vanes 21, up to, and even including, a fringe region adjacent the outer periphery of the spinner vane assembly 20. Thus, a similar uniform fuel dispersion exists over the entire transverse cross sectional area of the flow of the combustion air over which the spinner vane assembly 20 extends.

Gap spaces and vane dimensions discussed herein were representative and may be modified. Other ranges or sizes may be equally or even more effective than the particular examples given herein. As a system for distributing the fuel from the interior of the vanes 21, the uniformly maintained trailing edge slots 83 were found to be effective to obtain low pollutant contents in the final combustion products of the burner unit 10. However, a change in the number of blades or spinner vanes 21 in the spinner vane assembly may be effected without changing the arrangement 67 as a whole. Other changes and modifications are of course possible. Within the scope of the invention, fuel dispersion openings other than a single trailing edges slot 83 in each of the vanes may be considered. For example, a series of fuel dispersion openings in a low pressure wake surface 89 of each spinner vane 21 may be patterned in numbers or size to match air flow conditions over each vane 21 and the spacing between adjacent vanes 21 to advantageously provide optimum fuel dispersion patterns. Any of these changes, or others, can be made within the scope of fuel dispersion over a cross-sectional area of the flow pattern of the combustion air, particularly the general feature of hollow spinner vanes as transverse, radial distribution passages for fuel. All suggested modifications relate even to the more specific aspect of the distribution chambers 80 within the spinner vanes 21 to distribute the fuel for the burner unit 10 transversely across an entire flow region of the combustion air. The advantage appears in the double function of the spinner vanes 21, namely to necessarily direct the flow of the air to induce the flame stabilizing back flow and at the same time to mix with the redirected air the fuel needed to produce the flame in the first place.

A further advantage pertains to a low pressure distribution pattern over the radial distance of the trailing edges 82 of the vanes 21. The pressure distribution pattern achieved by the described embodiment appears to enhance the uniformity of distribution of fuel drawn from the spider-like arrangement of vanes 21 over the air flow area of the spinner vane assembly 20. This radial velocity distribution is best explained with respect to FIG. 3. Wider spacing between adjacent ones of the spinner vanes 21 next to the peripheral vane assembly band 86 is believed to promote a somewhat higher air flow velocity toward the outer periphery of the spinner vanes 21, as compared to the air flow over the more closely spaced portions of the vanes 21 adjacent their bases 78. The resulting radial pressure distribution appears to draw a higher volume of fuel from radial regions of higher gas flow at which more fuel is needed for an even fuel distribution. The effect seems to account for very satisfactory results in the control of pollutants from the combustion process of the burner unit 10. The described trailing edge slots 83 and their uniform width represent, therefore, a currently preferred embodiment for dispersing fuel.

Figure 2:
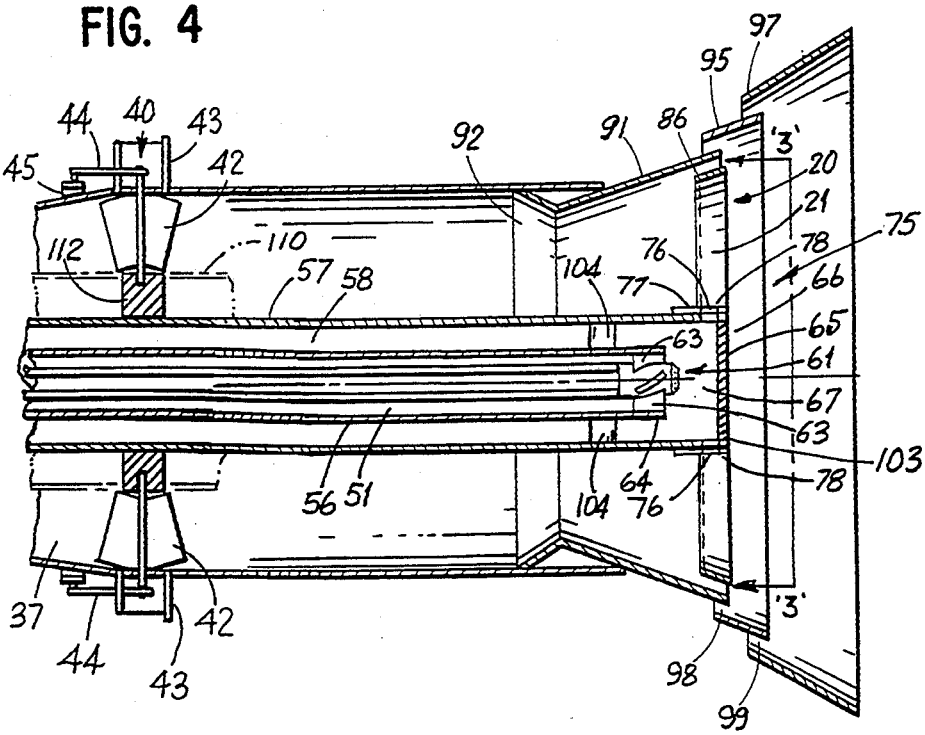
FIG. 2 is an enlarged sectional view through a portion of the turbo burner unit in FIG. 1, the sectional view revealing details of features of the present invention.

FIG. 2 shows in detail a particular embodiment of the burner head portion of the turbo burner unit 10. The air flow defining structure of the burner head 15 generally includes some of the proven features of the existing art. For example, a flaring portion 91 of the burner head 15 is shown as being preceded by a necked-down duct portion 92. A resulting venturi effect has been found to enhance a subsequent radial outflow of combustion air and smooth an overall flow pattern of the air through the burner head 15. Also, conical sections bounding the flame region 16 include a first frusto-conical flame holder ring 95 which fits over an end of the flaring portion 91 of the burner head 15. A flared end of the ring 95 is disposed in a second frusto-conical flame holder ring 97. A plurality of resulting annular gaps 98 and 99 admit further combustion air that is drawn in by the venturi effect of the high speed air flowing internally past the respective gaps 98 and 99. The flame holder cone arrangement of the burner unit 10 is similar to that of other, already existing burners. It appears, therefore, that the described fuel dispersion arrangement may be applicable as a modification to various existing turbo burners to enhance their operation.

Since the end 64 of the inner concentric tube 56 is recessed within a corresponding end 103 of the outer concentric tube 57, annular support vanes 104 for the inner concentric tube 56 may be formed as gas spinner vanes 104, having a skew with respect to the longitudinal axis. The direction of skew of the support vanes 104 are preferably opposite to the direction of skew of the spinner vanes 63 of the atomizer assembly 61. The oppositely directed support vanes 104 and spinner vanes 63 take on significance to generate turbulent flow conditions within the manifold chamber when the burner unit 10 is to be operated with liquid fuel. Addition of turbo air via the spinner vanes 63 may be omitted when the burner unit 10 operates on gaseous fuel. In such event the atomizer assembly 61 would understandably be idle. Adding the turbo air via the central space 51 with a swirl induced by the spinner blades 63 to pre-mix with the gaseous fuel may cause pre-ignition of the fuel. Furthermore, a desirably uniform air and fuel mixture may be obtained by introducing the gaseous fuel in the described manner via the trailing edges 83 of the spinner vanes 21.

If, however, the burner unit 10, as described herein, is sought to be operated with liquid fuel, atomization of the liquid fuel and vaporization of the fuel into a combustible gas desirably precedes a final mixing of the fuel with the requisite amounts of combustion air. A supply of compressed gas is typically fed to the atomizer assembly via the compressed gas line 60. Atomization into small droplets of fuel is achieved by mixing the fuel and the compressed air in a turbulent flow environment of the atomizer assembly 61. Any further mixing of the liquid fuel with a gas should endeavor to avoid pre-ignition of the injected fuel before the mixture is distributed into the combustion air via the mixing slots 83 at the trailing edges of the spinner vanes 21. Thus, the feeder pipe 72 may be adapted to a gas-fuel mixing function and may be coupled for that purpose to a supply of oxygen-starved gas. A supply of such oxygen-starved or oxygen-poor gas may be obtained from combustion effluents, exhausted from the burner, compressed and re-routed. These re-routed gases may be preprocessed, such as by a compressor, not shown. The burner exhaust gases would be high in carbon dioxide and in superheated water vapors, but would generally lack free oxygen which might cause pre-ignition of the fuel. As an alternative to re-routed combustion effluents, superheated steam may be used as a source of a gas which lacks free oxygen. The oxygen-poor gas would be used, in the case of liquid fuel operations, as a carrier gas for the atomized fuel. The carrier gas suspends the fine droplets of fuel and substantially uniformly distributes them throughout its gaseous volume. Generally, the carrier gas would also transfer heat energy to the fuel droplets, thereby fostering the vaporization of the fuel while the fuel is being carried to the distribution chambers 80 of the spinner vanes 21. Upon exiting the distribution chambers 80, the fuel will be mixed with the turbo air in the same manner as the gaseous fuel in its path to the flame region 16.

With a further modification of the burner unit 10, it is contemplated to also use the burner unit 10 with a supply of solid fuel and to mix the solid fuel substantially in the manner described with respect to gaseous and liquid fuels. The advantages of the fuel arrangement 75 are therefore not limited to a single type of fuel. FIG. 1 shows, in phantom lines, a third concentric tube 110 that may be inserted as a modification into the burner unit 10 to route a solid fuel, such as in the form of coal dust, carried by a carrier gas, to the distribution chambers 80 of the spinner vanes 21. The solid fuel and the carrier gas may be fed to the third concentric tube via a header coupling 111, for example. In FIG. 2, the damper blades 42 are supported on a support ring 112 for either liquid or gaseous fuel usages. Thus, in the event the use of the third concentric tube 110 is desired, the support ring 112 may be removed, but the damper assembly 40 and combustion air access remains otherwise unchanged. Though the use of the third concentric tube 110 (a portion of which is shown in phantom lines in FIG. 2) would require the removal of the support ring for the damper blades 42, the damper blades 42 will be supported directly by the wall of the tube 110, as shown in FIG. 2. Because of undesirable features of solid fuels, such as an abrasive characteristic of even finely divided coal dust, known solid fuels may not be desirable to be used in the burner unit 10, but should, on the other hand, be considered for distribution in accordance herewith, when the need for use of solid fuels arises.

Though certain variations and modifications have already been referred to or described, it is to be understood that various other changes and modifications in the use and implementation of the described embodiments are possible without departing from the spirit and scope of the invention as set forth in the claims.

What is claimed is:

1. A burner unit having a longitudinal axis; a burner head disposed along the longitudinal axis; a source of forced combustion air disposed upstream of the burner head, the source generating a stream of combustion air generally along the longitudinal axis past the burner head; a flame region disposed downstream of the burner head; a fuel source coupled to the burner head; a vane assembly having a plurality of fixed vanes disposed, spaced about, and extending substantially radially outward from the longitudinal axis; each of the vanes having the shape of an airfoil and being disposed at an angle with respect to the generally axial direction of the flow of the combustion air to direct the combustion air radially outward with respect to the longitudinal axis; each of the vanes having a hollow fuel distribution chamber, the fuel distribution chambers being coupled to the fuel source; and each of the vanes having at least one opening disposed to distribute fuel from the fuel source substantially uniformly over the length of the vane to the combustion air adjacent the respective vane as the combustion air passes the vane in its path to the flame region of the burner unit.

2. The burner unit according to claim 1, wherein the fuel source coupled to the burner head comprises inner and outer concentric tubes disposed concentric with the longitudinal axis and terminating at a manifold chamber formed at an end of the outer concentric tube, and further comprises a plurality of channels extending at the manifold chamber radially through the wall of the outer concentric tube, each channel communicatively coupling the manifold chamber with a respective one of the fuel distribution chambers of the vanes.

3. The burner unit according to claim 2, wherein the fuel source coupled to the burner head further comprises an atomizer assembly disposed at the manifold chamber, the atomizer assembly being coupled to a liquid fuel supply and having means for supplying liquid fuel in the form of a spray of small droplets of fuel to the manifold chamber.

4. The burner unit according to claim 3, wherein an annular space between the inner and outer concentric tubes is coupled to a supply of oxygen-poor gas to route an oxygen-poor gas as a carrier gas to the manifold chamber.

5. The burner unit according to claim 2, wherein an annular space between the inner and outer concentric tubes is coupled to a supply of gaseous fuel source to route a gaseous fuel to the manifold chamber.

6. The burner unit according to claim 1, wherein the vanes are formed of respective sheets of metal into shapes of the airfoil, each sheet being formed back on itself, and having adjacent trailing edges, the trailing edges of the sheet being disposed at a space with respect to each other, the spaced trailing edges forming the trailing edge of the vane, an interior space enclosed by the sheet of metal constituting the hollow fuel distribution chamber and the space between the trailing edges of the sheet constituting the at least one opening disposed to distribute fuel over the length of the vane.

7. The burner unit according to claim 6, wherein the space between the trailing, formed over edges of the sheet of each vane is of a uniform width over the radial length of the respective vane.

8. A burner unit having a longitudinal axis and comprising:

(a) a burner head disposed along the longitudinal axis of the burner unit;

(b) means for supplying a stream of combustion air to flow generally along the longitudinal axis in a downstream direction past the burner head;

(c) a flame region disposed downstream of the burner head; and (d) fuel source means coupled to the burner head, the burner head including a vane assembly having a plurality of vanes disposed radially in a plane transverse to the general direction of flow of the combustion air; each vane being an airfoil disposed at an angle with respect to the axial direction of flow of the combustion air to deflect the stream of combustion air to flow conically outward with respect to the longitudinal axis; each vane having internally thereof a hollow space, the hollow space of each vane being coupled to the fuel source means to receive fuel; and each vane further having means for distributing fuel received within the hollow space area-wide over the length of the vane to the combustion air as the combustion air passes each of the respective vanes.

9. The burner unit according to claim 8, wherein each vane has a trailing edge including a slot communicating with the hollow space and extending substantially the length of the trailing edge for distributing fuel from the trailing edge into the combustion air passing the vane on either side thereof.

10. A burner unit having a longitudinal axis and comprising a burner head disposed along the longitudinal axis, a fuel source and a fuel supply line leading to and terminating at the burner head, a combustion air source including a blower unit, the blower unit coupled to a power source for operating the blower unit to direct a stream of air flowing generally in a direction of the longitudinal axis past the burner head, a flame region disposed downstream of the burner head in the direction of air flow past the burner head, and a vane assembly disposed in a transverse plane at an interface between the burner head and the flame region, the assembly including a plurality of vanes disposed generally radially outward from the longitudinal axis, the vanes being shaped as airfoils each having a leading edge and a trailing edge and being oriented at an angle with respect to the longitudinal axis to induce into the stream of air a spin and a radially divergent flow away from the longitudinal axis, wherein each of the vanes is fixed and a gas distribution chamber is disposed within each of the vanes, a manifold chamber coupling the fuel supply line to each of the distribution chambers in a respective one of the vanes, and at least one communicative opening disposed in each vane and communicating between the respective distribution chamber and the stream of combustion air such that the fuel is distributed area-wide substantially over the lengths of the vanes into the stream of combustion air as the combustion air passes the vane assembly.

11. The burner unit according to claim 10, wherein the at least one communicative opening is a single slot extending along the trailing edge of each of the vanes.

12. The burner unit according to claim 10, wherein each of the vanes is comprised of a sheet of metal, the sheet being formed over on itself into the shape of an airfoil, the trailing edge of the airfoil being formed by adjacent trailing edges of the sheet, the adjacent trailing edges being spaced from each other to define a gap there between, the gap constituting the at least one communicative opening of each of the vanes.

13. The burner unit according to claim 12, wherein the gap between the adjacent formed-over trailing edges of the sheet forming respective ones of the vanes is of a substantially uniform gap width over the length of the trailing edge of the respective vane.

14. A burner unit having a longitudinal axis and comprising a burner head disposed along the longitudinal axis, a fuel source and a fuel supply line leading to and terminating at the burner head, a combustion air source including a blower unit coupled to a power source for operating the blower unit to direct a stream of air flowing generally in a direction of the longitudinal axis past the burner head, a flame region disposed downstream of the burner head in the direction of air flow past the burner head, and a vane assembly disposed in a transverse plane at an interface between the burner head and the flame region, the vane assembly including a plurality of vanes disposed generally radially outward from the longitudinal axis, the vanes being shaped as airfoils each having a leading edge and a trailing edge and being oriented at an angle with respect to the longitudinal axis to induce into the stream of air a spin and a radially divergent flow away from the longitudinal axis, wherein the improvement comprises a gas distribution chamber disposed within each of the vanes, a manifold chamber coupling the fuel line to each of the distribution chambers in a respective one of the vanes, and at least one communicative opening disposed in each vane and communicating between the respective distribution chamber and the stream of combustion air to distribute the fuel substantially over the length of the corresponding vane into the stream of combustion air as the combustion air passes the vane assembly; the at least one communicative opening being a single slot extending along the trailing edge of each of the vanes, each of the vanes comprising a spacer plug disposed generally midway adjacent the trailing edge, the spacer plug establishing a predetermined spacing of the trailing edge of each such vane.

* * * * *